US006093089A

United States Patent [19]

Chen et al.

[11] Patent Number: 6,093,089

[45] Date of Patent: Jul. 25, 2000

[54] APPARATUS FOR CONTROLLING UNIFORMITY OF POLISHED MATERIAL

[75] Inventors: Hsueh-Chung Chen, Taipei Hsien; Juan-Yuan Wu, Hsinchu; Water Lur, Taipei, all of Taiwan

[73] Assignee: United Microelectronics Corp., Hsinchu, Taiwan

[21] Appl. No.: 09/236,522

[22] Filed: Jan. 25, 1999

[51] Int. Cl.[7] ..... B24B 7/22

[52] U.S. Cl. ..... 451/288; 451/41

[58] Field of Search ..... 451/288, 287, 451/398, 388, 41, 24

[56] References Cited

U.S. PATENT DOCUMENTS

| | | | |
|---|---|---|---|
| 4,897,966 | 2/1990 | Takahashi | 451/287 |
| 4,918,869 | 4/1990 | Kitta | 451/288 |
| 5,605,488 | 2/1997 | Ohashi et al. | 451/288 |
| 5,851,135 | 12/1998 | Sandhu et al. | 451/288 |
| 5,916,016 | 6/1999 | Bothra | 451/398 |
| 5,975,998 | 11/1999 | Olmstead | 451/288 |

*Primary Examiner*—Robert A. Rose

[57] ABSTRACT

An apparatus for controlling a uniformity of a polished material is described. An air bag comprises a plurality of tubular rings. An air-bag manifold controller is connected to the tubular rings. The air-bag manifold controller controls inflation and deflation of the tubular rings in order to draw up the polished material and control pressure difference between different areas of the polished material.

10 Claims, 1 Drawing Sheet

APPARATUS FOR CONTROLLING UNIFORMITY OF POLISHED MATERIAL

BACKGROUND OF THE INVENTION

1. Field of the Invention

The present invention relates to a semiconductor fabricating apparatus. More particularly, the present invention relates to a polishing apparatus.

2. Description of the Related Art

Due to the increasing number of semiconductor devices incorporated in integrated circuits, multiple layers, such as multi-level metal interconnections, are utilized in most integrated circuit designs. In order to fabricating interconnects precisely, it is necessary for a wafer to have a good surface planarity.

Chemical-mechanical polishing (CMP) is widely used in a planarization process. In a chemical-mechanical polishing process, a rotation rate of a polishing pad, a rotation rate of a polishing head, a material of the polishing pad, and a pressure applied between the polishing pad and a wafer are all important factors that affect polishing results. Thus, the above-described factors need to be controlled during the chemical-mechanical polishing process. The polishing head is an especially important factor with respect to uniformity of the wafer. At present, the best polishing head is a floating polishing head, and it is widely used in the industry.

A conventional floating polishing head is simply described as follows. The floating polishing head comprises an air bag. The air bag has a tubular ring incorporated therein. The air in the tubular ring can be vacuumed, such that a wafer can be drawn up by the air bag.

In the conventional floating polishing head, there is only one ring utilized in the air bag. Normally, the tubular ring is kept at the same pressure as the air bag. There is no pressure difference between different areas of the wafer. The local pressures applied on different areas of the wafer thus are hard to control. This, in turn, causes the uniformity of chemical-mechanical polishing process are hard to control. The poor uniformity further causes a difference in thickness between the central area of the wafer and the edge area of the wafer. So, in practice, good wafer quality is difficult to obtain.

In addition, the difference in thickness between the central area of the wafer and the edge area of the wafer cause different lights to be reflected from the wafer. Different reflection lights with different colors easily lead to detection failure in the subsequent process, such as a defect scan process, performed on the wafer.

SUMMARY OF THE INVENTION

The invention provides an apparatus for controlling a uniformity of a polished material. A floating polishing head comprises an air bag. The air bag comprises a plurality of concentric, tubular rings. An air-bag manifold controller is connected to the tubular rings. The air-bag manifold controller also controls inflation and deflation of the tubular rings in order to draw up the polished material and control pressures applied on different areas of the polished material.

The air bag of the floating polishing head as described by the present invention comprises a plurality of concentric, tubular rings. Thus, the air-bag manifold controller can effectively control the local pressures applied on different areas of the polished material with the tubular rings. The pressure difference between different areas of the polishing material is preferably adjusted so that the polishing rate of the polished material is effectively controlled. The uniformity of the polished material surface is obtained. The quality of the polished material, such as a wafer, is enhanced.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
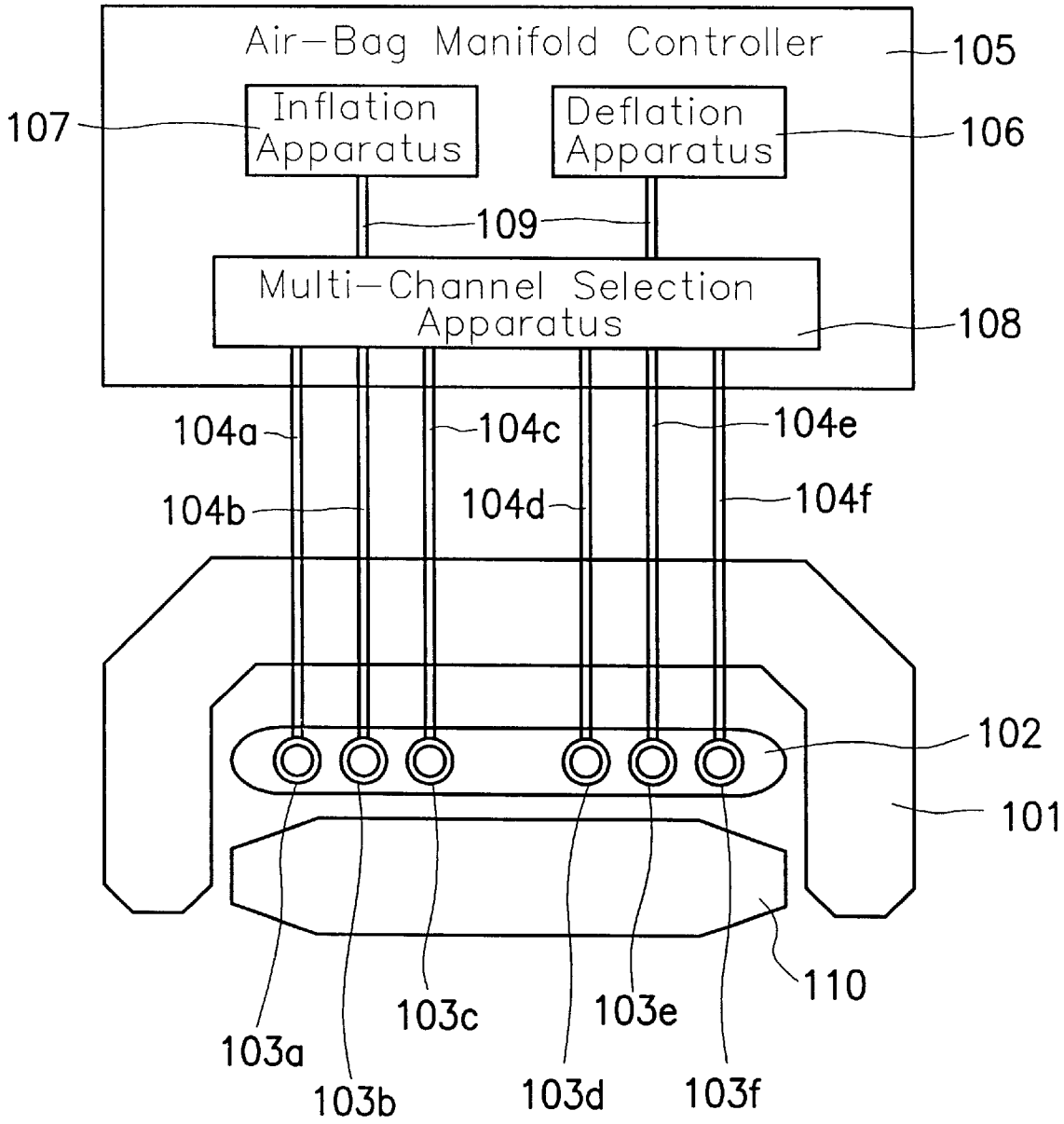
FIG. 1 is a schematic, cross-sectional view of a floating polishing head according to one preferred embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Reference is made to FIG. 1, which shows a schematic, cross-sectional view of a polishing head for a chemical-mechanical polisher. An air bag 102 is surrounded by a retaining ring 101. The air bag 102 comprises tubular rings having ring cross-sections 103*a*, 103*b*, 103*c*, 103*d*, 103*e*, and 103*f* located therein.

The tubular rings are preferably concentric and ring cross-sections 103*a*, 103*b*, 103*c*, 103*d*, 103*e*, and 103*f* preferably have different radii. So that the uniformity of polished material 110 can be better controlled, several rings can be incorporated into the air bag 102. This preferred embodiment takes the concentric, tubular rings with ring cross-sections 103*a*, 103*b*, 103*c*, 103*d*, 103*e*, and 103*f* as an example, but the invention is not limited to this particular number of rings.

The tubular rings having cross-sections 103*a*, 103*b*, 103*c*, 103*d*, 103*e*, and 103*f* are connected to an air-bag manifold controller 105. The air-bag manifold controller 105 controls inflation and deflation of the tubular rings with ring cross-sections 103*a*, 103*b*, 103*c*, 103*d*, 103*e*, and 103*f*. The tubular rings can be connected to the air-bag manifold controller 105 via, for example, pipes 104*a*, 104*b*, 104*c*, 104*d*, 104*e*, and 104*f*, although other suitable connection ways may be used.

The air-bag manifold controller 105 preferably comprises a deflation apparatus 106. The deflation apparatus are connected to the tubular rings with ring cross-sections 103*a*, 103*b*, 103*c*, 103*d*, 103*e*, and 103*f*. The deflation apparatus 106 can be connected to the concentric, tubular rings with ring cross-sections 103*a*, 103*b*, 103*c*, 103*d*, 103*e*, and 103*f* via, for example, pipes 104*a*, 104*b*, 104*c*, 104*d*, 104*e*, and 104*f*, but any other suitable connection ways may be used. The deflation apparatus 106 is used to perform a deflection action on the concentric, tubular rings with ring cross-sections 103*a*, 103*b*, 103*c*, 103*d*, 103*e*, and 103*f*.

The air-bag manifold controller 105 preferably comprises an inflation apparatus 107. The inflation apparatus 107 is connected to the rings 103*a*, 103*b*, 103*c*, 103*d*, 103*e*, and 103*f*. In this preferred embodiment, the inflation apparatus

108 is connected to the rings 103*a*, 103*b*, 103*c*, 103*d*, 103*e*, and 103*f* via the pipes 104*a*, 104*b*, 104*c*, 104*d*, 104*e*, and 104*f*, but any other suitable connection method may be used. The inflation apparatus 107 is used to inflate the tubular rings with ring cross-sections 103*a*, 103*b*, 103*c*, 103*d*, 103*e*, and 103*f*.

The controller 105 preferably comprises a multi-channel selection apparatus 108. The multi-channel selection apparatus 108 can be connected to the deflation apparatus 106 and the inflation apparatus 107 via, for example, pipes 109. The multi-channel selection apparatus 108 is used to decide whether or not to inflate or deflate the rings 103*a*, 103*b*, 103*c*, 103*d*, 103*e*, and 103*f* by the inflation apparatus 107 or deflation apparatus 106.

The following exemplary steps describe how the pressure applied on the polished material 110 is controlled. The deflation apparatus 106 and the inflation apparatus 107 are turned on. The deflation apparatus 106 and the inflation apparatus 107 are connected to the multi-channel selection apparatus 108 via the pipes 109. The multi-channel selection apparatus 108 opens valves (not shown) between the inflation apparatus 106 and the pipes 104*a*, 104*b*, 104*c*, 104*d*, 104*e*, and 104*f* while valves (not shown) between the deflation apparatus 107 and the pipes 104*a*, 104*b*, 104*c*, 104*d*, 104*e*, and 104*f* are closed. Thus, the air in the tubular rings having cross-sections 103*a*, 103*b*, 103*c*, 103*d*, 103*e*, and 103*f*, which are located in the air bag 102, is vented by deflation apparatus 106. As the air in the tubular rings having cross-sections 103*a*, 103*b*, 103*c*, 103*d*, 103*e*, and 103*f* is vented and vacuumed, the polished material 110 is drawn up by the air bag 102. A polishing step is performed on the polished material 110. The polished material 110 can be, for example, a wafer.

So as to obtain a uniformity of the polished material 110, the valves between the inflation apparatus 107, the pipes 104*a*, 104*b*, 104*c*, 104*d*, 104*e*, and 104*f*, and the multi-channel selection apparatus 108 are selectively opened or closed during polishing. For example, the multi-channel selection apparatus 108 opens the valve between the pipe 104*f* and inflation apparatus 107 while the other valves between the pipes 104*a*, 104*b*, 104*c*, 104*d*, 104*e* are closed. Meanwhile, the multi-channel selection apparatus 108 closes the valves between the deflation apparatus 106 and the pipes 104*a*, 104*b*, 104*c*, 104*d*, 104*e*, 104*f*. The inflation apparatus 107 inflates the tubular ring having ring cross-section 103*f* in the air bag 102. Inflation of the tubular ring having ring cross-section 103*f* applies pressure on the polished material 110. Consequently, the pressure locally adjusts the polishing rate of the polished material 110 that is near the tubular ring having cross-section 103*f*. There can be many exemplary steps for adjusting the polishing rate of the polished material 110 by selectively opening the valves. It is appreciated that the those skilled in the art can follow the above-described example to control the uniformity of the polished material 110, so these exemplary steps are not here described in detail. By adjusting local pressures applied on different areas of the polishing material 110 with the deflation apparatus 106 and the inflation apparatus 107, the preferable pressure difference between different areas of the polishing material 110 is obtained. In comparison with the conventional method, in which there is no pressure difference between different areas of a polishing material, the present invention provides preferably pressure difference between different areas of the polishing material 110. Thus, the uniformity of the present invention is obtained.

In summary, the invention includes at least the following advantages:

1. In comparison with the conventional method, the polishing head of the present invention includes an increased number of tubular rings in the air bag. Thus, the air-bag manifold controller can effectively control the pressure difference between difference areas of the polished material with the tubular rings. The pressure difference between the different areas of the polished material is adjusted properly. Therefore, the polishing rate of the polished material is effectively controlled. The uniformity of the polished material surface is obtained.

2. In the invention, the quality of the polished material, such as a wafer, is enhanced. The time and people required to ameliorate poor quality of the wafers are both significantly reduced. The fabrication cost for a wafer is thus reduced.

It will be apparent to those skilled in the art that various modifications and variations can be made to the structure and the method of the present invention without departing from the scope or spirit of the invention. In view of the foregoing, it is intended that the present invention cover modifications and variations of this invention provided they fall within the scope of the following claims and their equivalents.

What is claimed is:

1. An apparatus for controlling uniformity of a polished material, comprising:

an air bag comprising a plurality of tubular rings located inside the air bag, wherein the tubular rings have different radii and are concentric; and an air-bag manifold controller, connected to the tubular rings, wherein the air-bag manifold controller controls inflation and deflation of the tubular rings in order to draw up the polished material and control pressures applied on different areas of the polished material.

2. The apparatus of claim 1, wherein the polished material comprises a wafer.

3. The apparatus of claim 1, wherein the air-bag manifold controller comprises a deflation apparatus connected to the tubular rings in order to deflate the tubular rings.

4. The apparatus of claim 3, wherein the air-bag manifold controller comprises a multi-channel selection apparatus connected between the tubular rings and the deflation apparatus in order to deflate the tubular rings.

5. The apparatus of claim 1, wherein the air-bag apparatus comprises an inflation apparatus connected to the tubular rings in order to inflate the tubular rings.

6. The apparatus of claim 5, wherein the air-bag manifold controller comprises a multi-channel selection apparatus connected between the inflation apparatus and the tubular rings in order to control inflation of the tubular rings.

7. The apparatus of claim 5, wherein the air-bag manifold controller comprises an inflation apparatus and a deflation apparatus connected to the tubular rings in order to inflate and deflate the tubular rings.

8. The apparatus of claim 7, wherein the air-bag manifold controller comprises a multi-channel selection apparatus, wherein the inflation apparatus and the deflation apparatus are connected to the tubular rings via the multi-channel selection apparatus, the inflation apparatus controls the inflation of the tubular rings through the multi-channel selection apparatus, and the deflation apparatus control the deflation of the tubular rings through the multi-channel selection apparatus.

9. The apparatus of claim 8, wherein the multi-channel selection apparatus selectively controls the inflation of the tubular rings during polishing.

10. A method of controlling uniformity of a polished material, wherein a polishing head having a retaining ring is provided, an air bag comprising a plurality of tubular rings located therein is surrounded by the retaining ring, the tubular rings have different radii and are concentric, and an air-bag manifold controller comprising a deflation apparatus and an inflation apparatus is connected to the tubular rings, the multi-channel selection apparatus is connected to the tubular rings via a plurality of pipes, comprising:

turning on the inflation apparatus and the deflation apparatus;

opening the pipes between the deflation apparatus and the tubular rings and closing the pipes between the inflation apparatus and the tubular rings to vent air in the tubular rings incorporated into the air bag;

drawing a polished material by the air bag; and controlling the inflation of the tubular rings by the multi-channel selection apparatus selectively.

* * * * *